United States Patent [19]

Bläsing et al.

[11] 4,233,145

[45] Nov. 11, 1980

[54] DEVICE FOR THE PROCESSING OF POURABLE BULK MATERIAL

[75] Inventors: Horst Bläsing, Berlin; Manfred Gute, Nuremburg, both of Fed. Rep. of Germany

[73] Assignee: Schering Aktiengesellschaft, Berlin and Bergkamen, Fed. Rep. of Germany

[21] Appl. No.: 22,156

[22] Filed: Jun. 4, 1980

[30] Foreign Application Priority Data

Mar. 20, 1978 [DE] Fed. Rep. of Germany ..... 2812559

[51] Int. Cl.[3] ..... C25D 17/16; C25D 17/22

[52] U.S. Cl. ..... 204/202

[58] Field of Search ..... 204/198, 201, 202

[56] References Cited

U.S. PATENT DOCUMENTS

| | | | |
|---|---|---|---|
| 1,034,219 | 7/1912 | Dow | 204/202 |
| 2,538,242 | 1/1951 | Hannon | 204/202 |
| 3,073,324 | 1/1963 | Finston | 204/198 |
| 3,620,953 | 11/1971 | Inoue | 204/201 |

*Primary Examiner*—T. M. Tufariello

*Attorney, Agent, or Firm*—Michael J. Striker

[57] ABSTRACT

An apparatus for chemically and electrochemically processing, especially electroplating, flowable bulk material comprises a tank containing a chemical solution and a device forming a trough receiving the material to be processed, the device is removably supported on the tank to extend into the solution. The trough forming device comprises a perforated belt, preferably of plastic material and trained over an upper and a lower reversing roller and a tension roller turnably mounted on a pair of transversely spaced side plates, which laterally define the trough in such a manner that the upper run of the belt has a first branch extending from the lower reversing roller to the deepest point of the trough at a small angle to the horizontal, whereas the second branch of the upper run which extends from the deepest point to the upper reversing roller extends nearly in vertical direction. The belt is driven over a gear transmission by a reversible electromotor. During processing of the material the belt is driven in a direction so that the upper run moves from the lower reversing roller to the upper roller, whereby the steep branch prevents removal of the material from the trough, and after the processing of the material is finished, the trough forming device is lifted out of the tank and the drive of the belt is reversed so that the material will be discharged from the device over the first branch of the upper run and the lower reversing roller.

7 Claims, 3 Drawing Figures

DEVICE FOR THE PROCESSING OF POURABLE BULK MATERIAL

The invention relates to a device specifically for the chemical and electrochemical processing—preferably electroplating—of pourable bulk material.

Generally, above processing of pourable bulk material is carried out in drums or bells. The use of drums predominates because said use offers various advantages over bells, specifically if larger volumes and/or larger dimensioned parts are to be processed. Thus, normally bells, aside from the processing material receive also the entire volume of processing solution, which thus is relatively small so that any variations in concentration during processing cannot be avoided. If with bells are used and the processing consists of an electroplating operation, then there is a limit of the current density, which can be applied, because the anode must be accommodated in the operating space and that way the anode surface is limited. Though bell design types with perforated walls are known, where the bell bodies—as is the case with drums—are immersed in processing liquid filled absorption tanks, their use is limited only to the processing of small amounts of goods, because of their low processing material absorptivity.

Above type processing of pourable bulk material, therefore, is carried out mostly in drums, where the standard procedure is to attach the drum to a carrier, which accommodates also a driving motor for rotating the drum, and equipment for supplying the motor power and—if so required—the electroplating current.

This drum unit is moved from one processing station of the generally multi-stage processing system to another by means of a transporter device. The process is started by filling the material into drums and is terminated by its removal. Because the drums have filling holes equipped almost exclusively with covers, the locks of which must be manually operated, the employment of charging-and discharging station personnel is required.

For the purpose of maximally economizing on the processing of above parts most plant operations are automatically controlled or at least mechanized. This applies to the plants internal feed run-off, the control of processing baths, and both the supply and removal of processing material. However, up till now any attempts to incorporate the charging-and discharging operation for for all types of pourable bulk material to be processed in an automated operation have been unsuccessful.

Though drums are known, which for the required motion of processing material carry out a to-and-fro instead of a rotary motion, so that the charging hole remains uncovered and an automatic filling of the drum is effected and in which for discharging purposes the charging hole is automatically rotated by 180°, so that it faces downward and the material falls out, however, drums as these are not suitable for many types of parts to be processed because no sufficient degree of circulation is provided.

Other attempts made include automating also the process of opening and closing the drum cover. For this purpose many solutions are known, but none could be translated into practice on a larger scale. In most cases the reason for this was the high breakdown susceptibility of designs under high operational loads. Because processing is staged mostly in corrosive solutions, frequently the drums are manufactured of plastics. This type of material is essential for electroplating processes. The drawbacks of suitable plastics, however, are low mechanical strength, low elastic modulus, and a high thermal expansion coefficient, the effect of which under high operational loads is particularly negative for automatic cover opening-and locking devices.

The object of the invention is to produce an optionally automatic-chargeable and dischargeable device, which makes a uniform processing of pourable bulk material of any type possible.

This problem is solved according to the invention by a device, comprising a belt, which is guided via deflector rollers and by means of lateral check plates so that a trough for the processing material is produced, and the endless belt is moveable for circulating said processing material.

Preferable embodiments of this device consist in that the trough part exiting in the standard belt feed direction ascends at an angle, which prevents the processing material from getting fed over the rim of the trough, that the trough part rising counter the standard belt feed direction ascends at an angle, which effects that on reversing said belt feed direction the processing material is fed over the trough rim, that the trough angular inclination in and counter the belt feed direction is variable, that the device contains a motor, preferably an electric motor, which serves to drive the endless belt, that the device is fixedly attached to a processing station, and is immersed into and lifted again from the processing medium by means of a raising-and lowering device, that the device is developed as a transportable design unit, which can be conveyed from one processing station to another by a feeder device.

that the device is fixedly attached to several series-arranged processing stations, and following each lifting of the device from the processing medium the continuous feed of pourable bulk material to the next station is effected by a reversal of the drive of the endless belt, and that the device extends over a plurality of processing stations, whereby a single endless belt being carried through one station after another to form each time in the latter—together with lateral check plates—a processing trough.

Further preferred features of the invention consist in that the endless belt during the processing time of pourable bulk material is in continuous motion, that the endless belt during the processing time of pourable bulk material is in intermittent motion, that the endless belt during the processing time of pourable bulk material is in alternate to-and-fro motion, that the endless belt comprises an elastic material, preferably a soft plastic, of which the dimensional stability perpendicular to the feed direction is reinforced by support bodies made of a nonelastic material, preferably a rigid plastic, that the endless belt consists of single elements, which are produced from a nonelastic material, preferably a rigid plastic, and said single elements are flexibly interconnected, and that the endless belt comprises a web.

Using a device according to the invention specifically makes feasible the chemical and electrochemical processing, preferably electroplating, of pourable bulk material of any type. The uniform surface treatment of all parts is insured, since the mutual position of the parts and that their contact points are constantly varied by the constant circulation and in this way a thorough mixing of the packed goods is attained. It is also assured that ever alternating parts get to the outer surfaces of the packed goods, which is particularly important for electroplating purposes. In addition the charging of the material into the device and discharging therefrom may be automated.

A further advantage of the device according to the invention resides in the fact that rinsing operations required between processing in active baths can be carried out on the open-laid goods by socalled injection rinsing, that is by spraying on a rinsing fluid, generally water, whereby the required amount of rinsing fluid is less than with socalled immersion rinsing.

The invention is described below in more detail with reference to the accompanying drawings wherein.

Figure 1:
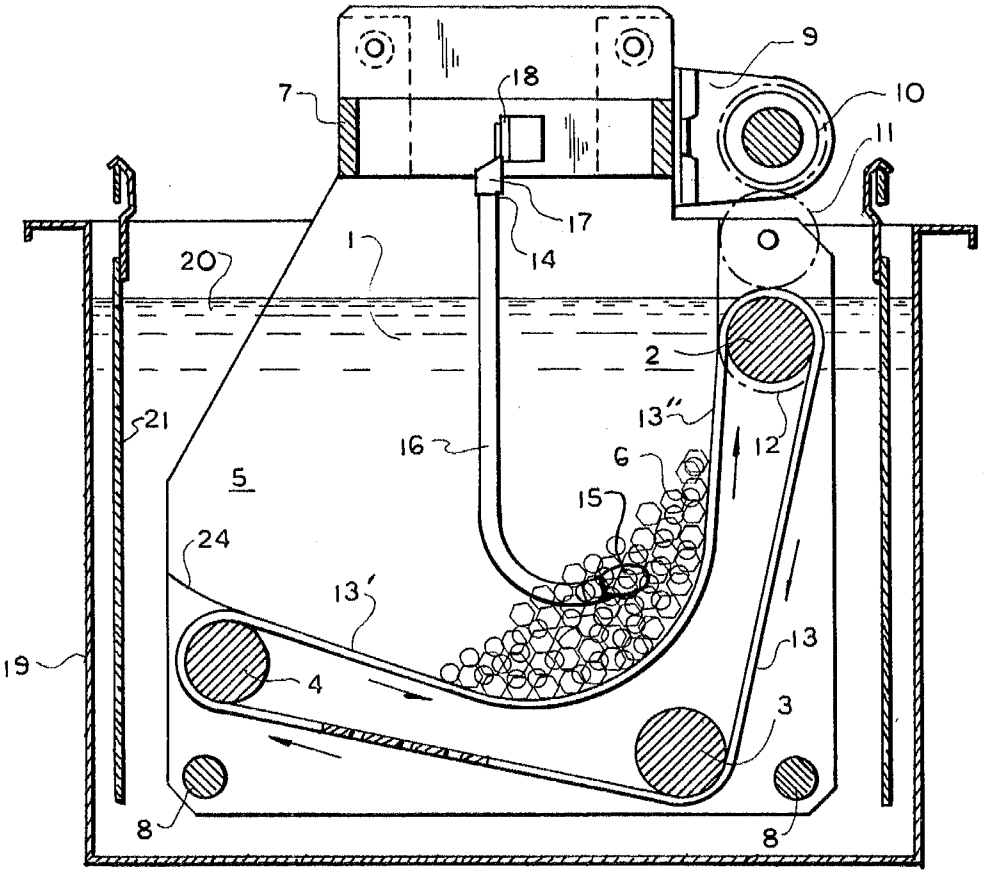
FIG. 1 is a cross sectional view through the device for processing pourable bulk material.

FIG. 1 shows a cross-section through device (1). In this case part (13) is the endless belt, which is so guided via or reversing rollers (2, 3, and 4) and through frontal check plates (5) that a pickup trough for processing material (6) is produced. Check plates or side plate means (5) are attached to a carrier frame (7) and interconnected at their bottom end by spacer rods (8). Coarranged on carrier frame (7) is an electric motor (9), which drives the upper deflector roller (2) and in this way endless belt (13) via gearwheels (10, 11, and 12).

The described device is suitable for electroplating and contains a cathodic current supply (14), which consists of a contact piece (15), and a flexible insulator cable (16) with cable bracket (17). The latter is screw connected to current feeder bar (18), which is connected to a DC source via electrical conductors (not shown).

In tank (19), which receives processing solution (20), anodes (21) are suspended as antipoles. Endless belt (13) is perforated so that the processing medium and electroplating current may pass therethrough. In this case said belt is made of an elastic plastic.

Figure 2:
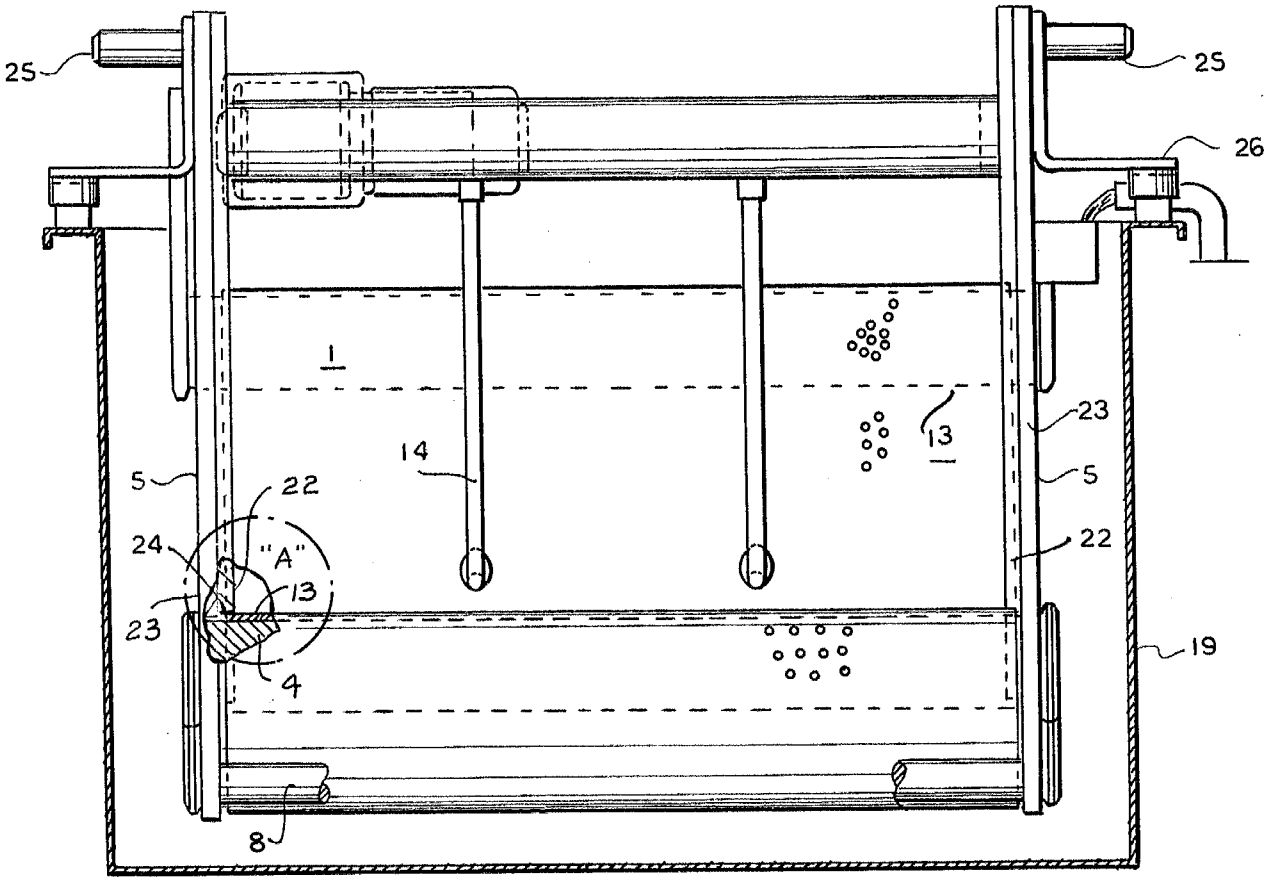
FIG. 2 is a front view of the device of FIG. 1.

In FIG. 2 a frontal view of device (1) is shown. Each of the check plates (5) comprises an inner (22) and an outer (23) plate. The bottom edge of the respective inner plate (22) simultaneously forms a guideway (24) for the upper rim of the endless belt (13), as shown in detail "A." Said guideway (24) is curved in the belt run direction, as shown in FIG. 1, so that belt (13) is constantly pressed against the way by its own tension. This prevents any parts of processing material (6) from getting between belt (13) and guideway (24). Belt (13) tension is produced by positionally varying at least one of the three deflector rollers (2, 3, and 4) so that either one operates as tensioning device.

In this described embodiment device (1) can be developed as transportable unit, which is conveyed from one processing station to another with a transporting device.

Retainer pins (25) are used for connecting the transporting device (not shown).

The device 1 is mounted at the rim of tank (19) by supporting angles (26). Via the latter also the electroplating current is supplied.

Figure 3:
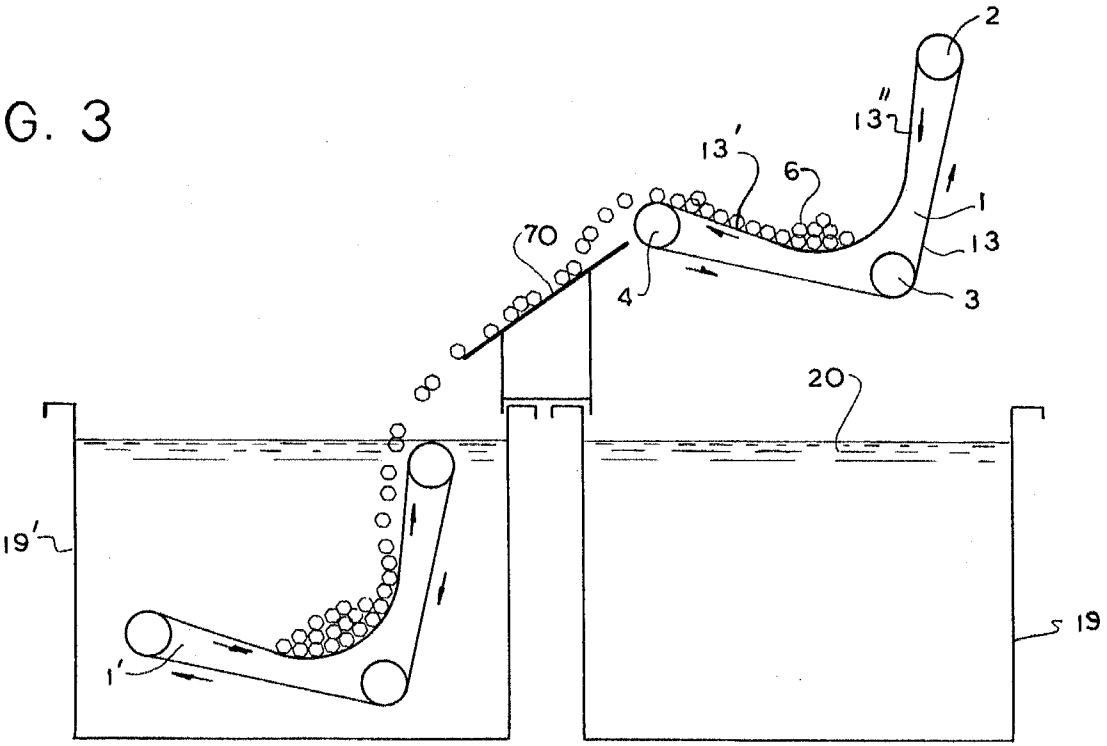
FIG. 3 is a schematic view of the discharge of the processing material.

FIG. 3 schematically shows how the device 1 according to the invention, can after the processing of the material has been terminated tank (19), be lifted out of the tank 1 by means of a hoisting device not shown and to discharge the processing material (6) by reversing the belt (13) feed direction, indicated by the arrows, over a deflector plate 70 into the device 1' in an adjacent tank 19'. As best shown in FIG. 3 the upper run of the belt has between the reversing roller 4 and the deepest point of the trough a portion 13' inclined at a small angle to the horizontal and between the deepest point and the upper reversing roller 2 a portion 13" extending nearly vertical.

We claim:

1. A device for chemically and electro-chemical processing, especially electroplating, of pourable bulk material, comprising a tank adapted to contain a chemical solution; means removably supported on said tank spaced from the inner surface thereof for forming a trough to receive the material to be processed, said trough forming means comprising a pair of transversely spaced side plate means, a pair of reversing rollers turnably mounted in said side plate means with one of said reversing rollers at a lower elevation and the other at a higher elevation, an endless perforated belt extending about said reversing rollers and having an upper and a lower run, said side plate means being constructed to guide said upper run of said belt along a path having a first branch descending from said reversing roller mounted at said lower elevation of said side plate means at a small angle to the horizontal to a deepest point of said trough and a second branch rising from the deepest point in nearly vertical direction to the reversing roller at the higher elevation, and a tension roller engaging the lower run of said belt; means connected to said side plate means for removably supporting said trough forming means on said tank and for connecting lifting means to said trough forming means so that the latter may be lifted out of said tank; and reversible drive means operatively connected to one of said rollers to drive said belt in one or the other direction so that during processing the material said upper run may be driven in a direction moving from the lower reversing roller towards the upper reversing roller, whereby said second nearly vertical branch of said upper belt will retain the material in the trough while when the trough forming means is lifted out of said tank, said drive means may be reversed so that the material will be discharged from the trough over said first branch of said upper run and the lower reversing roller.

2. A device as defined in claim 1, wherein said reversible drive means are operatively connected to the reversing roller at said higher elevation.

3. A device as defined in claim 2, wherein said reversible drive means is a reversible electromotor.

4. A device as defined in claim 3 and including a carrier frame connecting upper ends of said side plate means projecting upwardly beyond a treating solution in said tank to each other, said reversible electromotor being mounted on said carrier frame, and including transmission means between said motor and said reversing roller at said higher elevation.

5. A device as defined in claim 1, wherein each of said side plate means comprises an inner plate having a curved bottom edge in engagement with a lateral portion of said upper run of said belt for guiding the latter along the path between said two reversing roller and an outer plate fixed to said inner plate and having a straight bottom edge located downwardly of the bottom edge of the inner plate so that the trough forming means may, when removed from said tank, rest on the bottom edges of the outer plates.

6. A device as defined in claim 1 and including anode means suspended on said tank and adapted to extend into a solution contained therein and cathode means extending into the interior of said trough forming means.

7. A device as defined in claim 1 wherein said perforated belt is formed from plastic material.

* * * * *